US011167955B2

(12) United States Patent
Saarela et al.

(10) Patent No.: US 11,167,955 B2
(45) Date of Patent: Nov. 9, 2021

(54) METHOD AND SYSTEM FOR GENERATING MAINTENANCE DATA OF AN ELEVATOR DOOR SYSTEM

(71) Applicant: KONE Corporation, Helsinki (FI)

(72) Inventors: Sami Saarela, Helsinki (FI); Aki Haikonen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 816 days.

(21) Appl. No.: 15/969,309

(22) Filed: May 2, 2018

(65) Prior Publication Data

US 2018/0334363 A1 Nov. 22, 2018

(30) Foreign Application Priority Data

May 17, 2017 (EP) ..... 17171439

(51) Int. Cl.

| | |
|---|---|
| ***B66B 13/02*** | (2006.01) |
| ***B66B 5/00*** | (2006.01) |
| ***B66B 13/14*** | (2006.01) |
| ***B66B 13/22*** | (2006.01) |
| ***B66B 13/24*** | (2006.01) |

(52) U.S. Cl.

CPC ..... *B66B 13/02* (2013.01); *B66B 5/0025* (2013.01); *B66B 13/146* (2013.01); *B66B 13/22* (2013.01); *B66B 13/24* (2013.01)

(58) Field of Classification Search

CPC ..... B66B 13/02; B66B 5/0025; B66B 13/146; B66B 13/22; B66B 13/24; B66B 1/3446; B66B 5/0031; B66B 5/0037; B66B 5/02

See application file for complete search history.

(56) References Cited

U.S. PATENT DOCUMENTS

| | | | | |
|---|---|---|---|---|
| 4,750,591 | A * | 6/1988 | Coste | B66B 5/0006 187/391 |
| 6,330,936 | B1 | 12/2001 | Lence Barreiro et al. | |
| 9,988,239 | B2 * | 6/2018 | Toutaoui | B66B 29/00 |
| 10,766,745 | B2 * | 9/2020 | Gil-Arias | B66B 5/0018 |
| 10,829,344 | B2 * | 11/2020 | Koushik | B66B 5/0037 |

(Continued)

FOREIGN PATENT DOCUMENTS

JP 7-309565 A 11/1995

OTHER PUBLICATIONS

European Search Report of application 17 17 1439, dated Oct. 31, 2017.

*Primary Examiner* — Jeffrey Donels

(74) *Attorney, Agent, or Firm* — Birch, Stewart, Kolasch & Birch, LLP

(57) ABSTRACT

A method for generating maintenance data of an elevator door system includes detecting a first event during closing or opening of a door of the elevator door system and defining a time stamp of the first event, wherein the first event is opening or closing of a safety circuit; detecting at least one second event during said closing or opening of the door of the elevator door system and defining time stamp of the at least one second event; defining a difference value by comparing the time stamp of the first event and the time stamp of the at least one second event; comparing the difference value to previously stored one or more difference values; and generating maintenance data of the elevator door system. A system is provided to perform at least partly the method.

20 Claims, 6 Drawing Sheets

(56) References Cited

U.S. PATENT DOCUMENTS

| | | | | |
|---|---|---|---|---|
| 2016/0125348 | A1* | 5/2016 | Dyer | H04W 4/33<br>705/7.42 |
| 2019/0193991 | A1* | 6/2019 | Kohl | B66B 25/006 |
| 2020/0301405 | A1* | 9/2020 | Zhang | G05B 23/0272 |

* cited by examiner

METHOD AND SYSTEM FOR GENERATING MAINTENANCE DATA OF AN ELEVATOR DOOR SYSTEM

TECHNICAL FIELD

The invention concerns in general the technical field of elevators. Especially the invention concerns safety of an elevator system.

BACKGROUND

Typically an elevator system comprises an elevator car and a hoisting machine configured to drive the elevator car in an elevator shaft between landings. The elevator car may comprise an elevator car door and a door control unit. The door control unit is configured to control the operation, i.e. opening and closing, of the elevator car door. Furthermore, each landing may comprise a landing door. The elevator car door, one or more landing doors, and the door control unit may form an elevator door system. When the elevator car arrives to a landing, the elevator car door is configured to open and clasp the landing door of landing in question in order to open the landing door together with the elevator car door.

There may occur several misoperations, such as failures or malfunction, in the operation of the elevator door system. In most cases when a misoperation occurs the operation of the elevator is stopped and it may not continue before the elevator is fixed. Typically, a user of the elevator is the one who notices the failure or the malfunction first and informs an elevator service unit, such as service personnel, service center, service company or similar. Alternatively or in addition, an automated notification, for example in form of at least one failure code, may be delivered directly from an elevator control system, for example, to the elevator service. After that a maintenance personnel may be instructed to fix the problem in the elevator.

Typically it may take a long time for the information about a failure of the elevator door system to reach from the user of the elevator or the elevator control system to the elevator service unit. Furthermore, when the failure or malfunction is noticed the operation of the elevator is already stopped and there may be a long delay between the noticing of the failure or malfunction and the repair of the elevator door system. This may cause that the availability of the elevator is reduced, i.e. the time that elevator is in operation is reduced.

Typically, the elevator system further comprises one or more safety circuits in order to enhance the safety of the elevator system. The safety circuit is configured to ensure that the hoisting machine is stopped and/or that the stopped hoisting machine is not allowed to start, when movement of the elevator car may cause harm to persons or property. Typically, the safety circuit may be independent from other electrical systems of the elevator system, such as door control, drive, signalization, and alarm system. In a normal operation of the elevator system the safety circuit allows the elevator control system to move the elevator car from landing to landing. However, if something is detected to be wrong, the safety circuit is opened and the movement of the elevator car is stopped.

The safety circuit comprises one or more safety contacts, i.e. safety switches, connected in series. Some examples of safety contacts may be for example elevator car door contact, landing door contact, door lock contact, etc. When all the safety contacts are closed the safety circuit forms a closed loop and current may pass through the safety circuit, i.e. the safety circuit is in a close state. In the closed state the safety circuit enables that the elevator car is allowed to move. However, if at least one of the safety contacts is open, the safety circuit is in an open state and the current may not pass through the safety circuit. In the open state the safety circuit prevents the operation of the elevator, i.e., the elevator car is not allowed to move.

According to one prior art solution the condition of an elevator door system may be monitored by measuring a door motor current. If the door motor current exceeds a predefined limit, it may indicate a failure in the elevator door system.

SUMMARY

An objective of the invention is to present a method and a system for generating maintenance data of an elevator door system. Another objective of the invention is that the method and a system for generating maintenance data of the elevator door system enable early detection of a need for maintenance.

The objectives of the invention are reached by a method and a system as defined by the respective independent claims.

According to a first aspect, a method for generating maintenance data of an elevator door system is provided, wherein the method comprising: detecting a first event during closing or opening of a door of the elevator door system and defining a time stamp of the first event, wherein the first event is opening or closing of a safety circuit comprising at least one safety contact; detecting at least one second event during said closing or opening of the door of the elevator door system and defining time stamp of the at least one second event, defining a difference value by comparing the time stamp of the first event and the time stamp of the at least one second event; comparing the difference value to previously stored one or more difference values; and generating maintenance data of the elevator door system, wherein the maintenance data comprising at least part of the results of the comparison.

The method may further comprise: storing the maintenance data; comparing the maintenance data to a previously stored maintenance data; and generating a signal indicating an immediate need for maintenance of the elevator door system in response to a detection that the received maintenance data deviates from the previously stored maintenance data over a predefined limit, or generating a signal indicating a predictive need for maintenance of the elevator door system in response to a detection that the stored maintenance data together with the previously stored maintenance data indicates a longtime trend of a deviation in the stored maintenance data.

The door of the elevator door system may be at least one of the following: elevator car door, landing door.

The at least one safety contact of a safety circuit may be at least one of the following: elevator car door contact, landing door contact, elevator car door lock contact, landing door lock contact.

The one or more previously stored difference value may be at least one of the following: difference value previously defined and stored for the same safety circuit at the same landing, difference value previously defined and stored for the same safety circuit at one or more other landings, difference value previously defined and stored for one or more similar safety circuits. The one or more similar safety circuits may reside in different elevator, different elevator system, different elevator group, different building, or even in an elevator on the other side of the world.

The at least one second event may be at least one of the following: increase of a door motor current value, instruction from an elevator control unit to a door control unit of the elevator door system to open or close the door, random sequential repetition in the opening or closing of the safety circuit.

Alternatively or in addition, the safety circuit may implemented as a data-bus based safety circuit, wherein the at least one second event may further be opening or closing of at least one individual safety contact of the safety circuit.

According to a second aspect, a system for generating maintenance data of an elevator door system is provided, wherein the system comprising: a computing unit comprising: at least one processor, and at least one memory storing at least one portion of computer program code; and a detection unit comprising: at least one processor, and at least one memory storing at least one portion of computer program code; wherein the detection unit is configured to: detect a first event during closing or opening of a door of the elevator door system and define a time stamp of the first event, wherein the first event is opening or closing of a safety circuit comprising at least one safety contact; and detect at least one second event during said closing or opening of the door of the elevator door system and defining a time stamp of the at least one second event; wherein one of the following: detection unit, computing unit, is configured to: define a difference value by comparing the time stamp of the first event and the time stamp of the at least one second event; compare the difference value to previously stored one or more difference values; and generate maintenance data of the elevator door system, wherein the maintenance data comprising at least part the results of the comparison.

The computing unit may be configured to: store the maintenance data; compare the maintenance data to previously stored maintenance data; and generate a signal indicating an immediate need for maintenance of the elevator door system in response to a detection that the received maintenance data deviates from the previously stored maintenance data over a predefined limit, or generate a signal indicating a predictive need for maintenance of the elevator door system in response to a detection that the stored maintenance data together with the previously stored maintenance data indicates a longtime trend of a deviation in the stored maintenance data.

The door of the elevator door system may be at least one of the following: elevator car door, landing door.

The at least one safety contact of a safety circuit may be at least one of the following: elevator car door contact, landing door contact, elevator car door lock contact, landing door lock contact.

The previously stored difference value may be at least one of the following: difference value previously defined and stored for the same safety circuit at the same landing, difference value previously defined and stored for the same safety circuit at one more other landings, difference value previously defined and stored for one or more similar safety circuits. The one or more similar safety circuits may reside in different elevator, different elevator system, different elevator group, different building, or even in an elevator on the other side of the world.

The detection unit may be one of the following: an elevator control unit, a door control unit, a separate unit retrofittable to the elevator system.

The at least one second event may be at least one of the following: increase of a door motor current value, instruction from an elevator control unit to a door control unit of the elevator door system to open or close the door, random sequential repetition in the opening or closing of the safety circuit.

Alternatively or in addition, the safety circuit may be implemented as a databus based safety circuit, wherein the at least one second event may further be opening or closing of at least one individual safety contact of the safety circuit.

The exemplary embodiments of the invention presented in this patent application are not to be interpreted to pose limitations to the applicability of the appended claims. The verb "to comprise" is used in this patent application as an open limitation that does not exclude the existence of also un-recited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objectives and advantages thereof, will be best understood from the following description of specific embodiments when read in connection with the accompanying drawings.

BRIEF DESCRIPTION OF FIGURES

The embodiments of the invention are illustrated by way of example, and not by way of limitation, in the figures of the accompanying drawings.

DESCRIPTION OF SOME EMBODIMENTS

Figure 1:
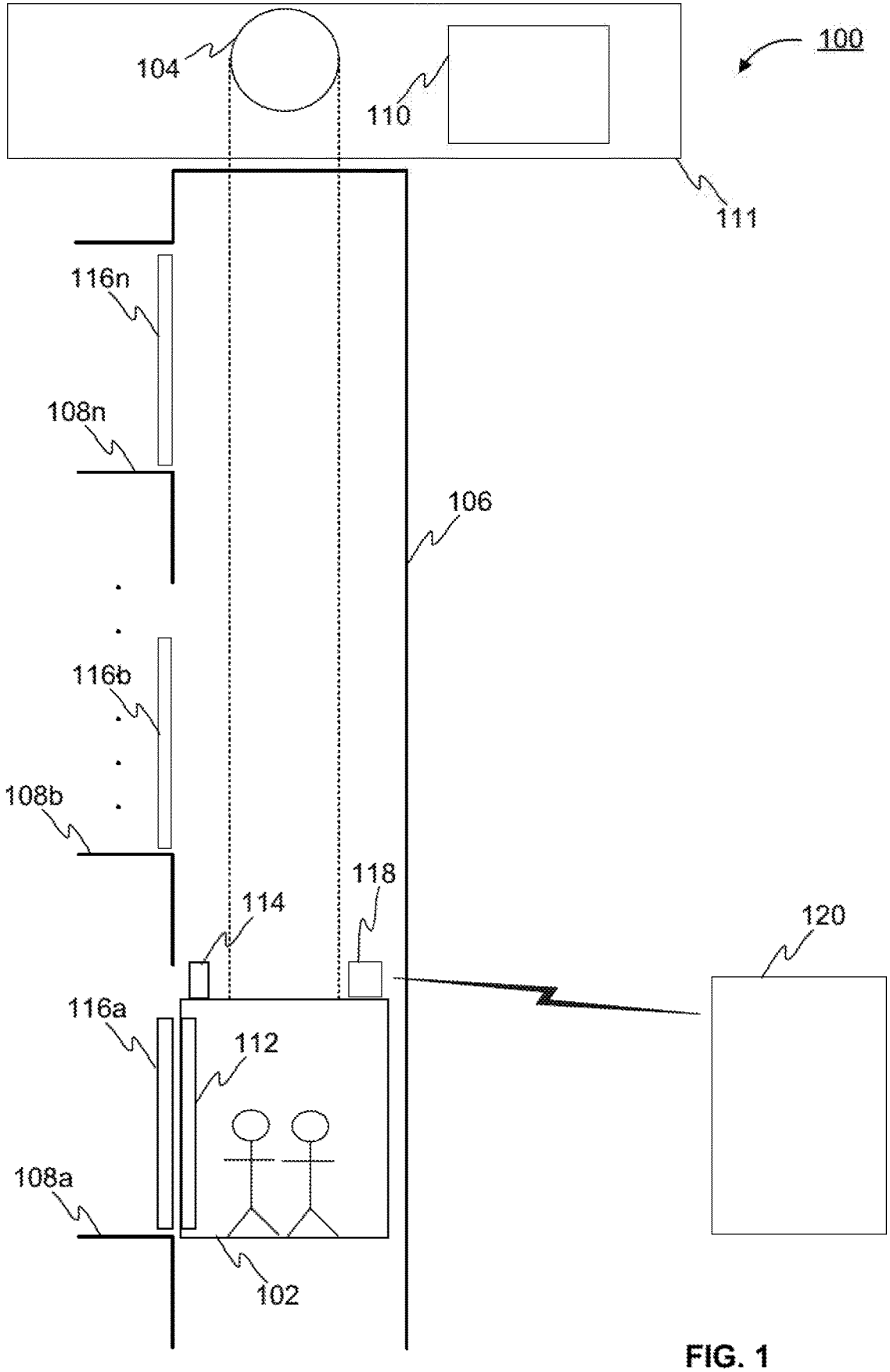
FIG. 1 illustrates schematically an example of an elevator system, wherein the embodiments of the invention may be implemented.

FIG. 1 illustrates schematically an example of an elevator system 100, wherein the embodiments of the invention may be implemented as will be described. The elevator system 100 may comprise an elevator car 102 and a hoisting machine 104 configured to drive the elevator car 102 in an elevator shaft 106 between landings 108*a*-108*n*. An elevator control unit 110 may be configured to control the operation of the elevator system 100. The elevator control unit may reside in a machine room 111. The elevator car 102 comprises an elevator car door 112 and a door control unit 114. Furthermore, each landing 108*a*-108*n* comprises a landing door 116*a*-116*n*. The door control unit 114 is configured to control the operation, i.e. opening and closing, of the elevator car door 112. When the elevator car 102 arrives to a landing 108*a*-108*n*, the elevator car door 112 is configured to open and clasp the landing door 116*a*-116*n* of landing 108*a*-108*n* in question in order to open the landing door

116*a*-116*n* together with the elevator car door 112. The elevator car door 112, one or more landing doors 116*a*-116*n*, and the door control unit 114 may form an elevator door system. A system for generating maintenance data of an elevator door system according to the invention may be implemented to the example elevator system illustrated in FIG. 1. The system for generating maintenance data of an elevator door system according to the invention comprises a detection unit 118 and a computing unit 120.

The detection unit 118 may be implemented as one of the following: elevator control unit 110, a separate unit retrofittable to the elevator system. In FIG. 1 the detection unit 118 is implemented as the unit retrofittable to the elevator car 102, but invention is not limited to that and the detection unit 118 may also be implemented as the elevator control unit 110 or door control unit 114. The retrofittable unit enables that the system and the method according to the invention may be implemented to any existing elevator system without the need for accessing the elevator control unit of the elevator system. The retrofittable unit may also comprise sensor related devices. The sensor related devices may comprise, but are not limited to, one or more sensor for detecting the current of the safety circuit, one or more sensor for detecting the state, i.e. open or closed, of the safety circuit, one or more sensor for detecting the movement of the elevator car door and/or landing doors.

The computing unit 120 may be an external computing unit. Some non-limiting examples of the external computing unit may e.g. be a remote server, cloud server, computing circuit, a network of computing devices. The external unit herein means a unit that locates separate from the elevator system 100. The use of the external computer unit as the computing unit enables that sufficiently large computational resources may be available compared to a use of an internal computing unit.

The elevator system 100 may further comprise one or more safety circuits 200. For sake of clarity the safety circuit is not shown in FIG. 1. The one or more safety circuit 200 may be for example a safety circuit for landing doors, safety circuit for elevator car door, or a common safety circuit for elevator car door and landing doors. Each safety circuit comprises one or more safety contacts 202, i.e. safety switches. The safety contacts 202 may be for example elevator car door contact, landing door contact, door lock contact, etc. The elevator car door contact represents whether the elevator car door is closed or open. The landing door contact represents whether the landing door is closed or open. The door lock contact represents whether the lock of the door is closed or open.

The safety circuit 200 may comprise at least two safety contacts 202 for each door, i.e. one door contact (an elevator car door contact or a landing door contact depending on the door in question) and a door lock contact of said door. If the door is a single opening door, i.e. the door comprises only single door panel, the safety circuit 200 may comprise one elevator car door contact, one door lock contact of the elevator car door, one landing door contact for each landing door and one door lock contact of each landing door. Alternatively, in case of the single opening door, separate safety circuits may be provided for the elevator car door and for the landing door. This means that the safety circuit of the elevator car door comprises one elevator car door contact and one door lock contact of the elevator car door and the safety circuit of the landing door comprises one landing door contact for each landing door and one door lock contact of each landing door. If the door is center opening door, i.e. the door comprises two door panels that meet in the middle and slide open laterally, the safety circuit may comprise one elevator car door contact of each elevator door panel, one door lock contact of each elevator door panel, one landing door contact of each landing door panel and one door lock contact of each landing door panel. Alternatively, in case of the center opening door, separate safety circuits may be provided for the elevator car door and for the landing door. This means that the safety circuit of the elevator car door comprises one elevator car door contact of each elevator door panel, one door lock contact of each elevator door panel and the safety circuit of the landing door comprises one landing door contact of each landing door panel and one door lock contact of each landing door panel. Furthermore, in case of center opening door, only one of the elevator car door panels is connected to a door motor in order to move said elevator car door panels. Said elevator car door panel is further connected to the other elevator car door panel by means of a cable of a synchronization system in order to open and close also the other elevator car door panels.

Figure 2A:
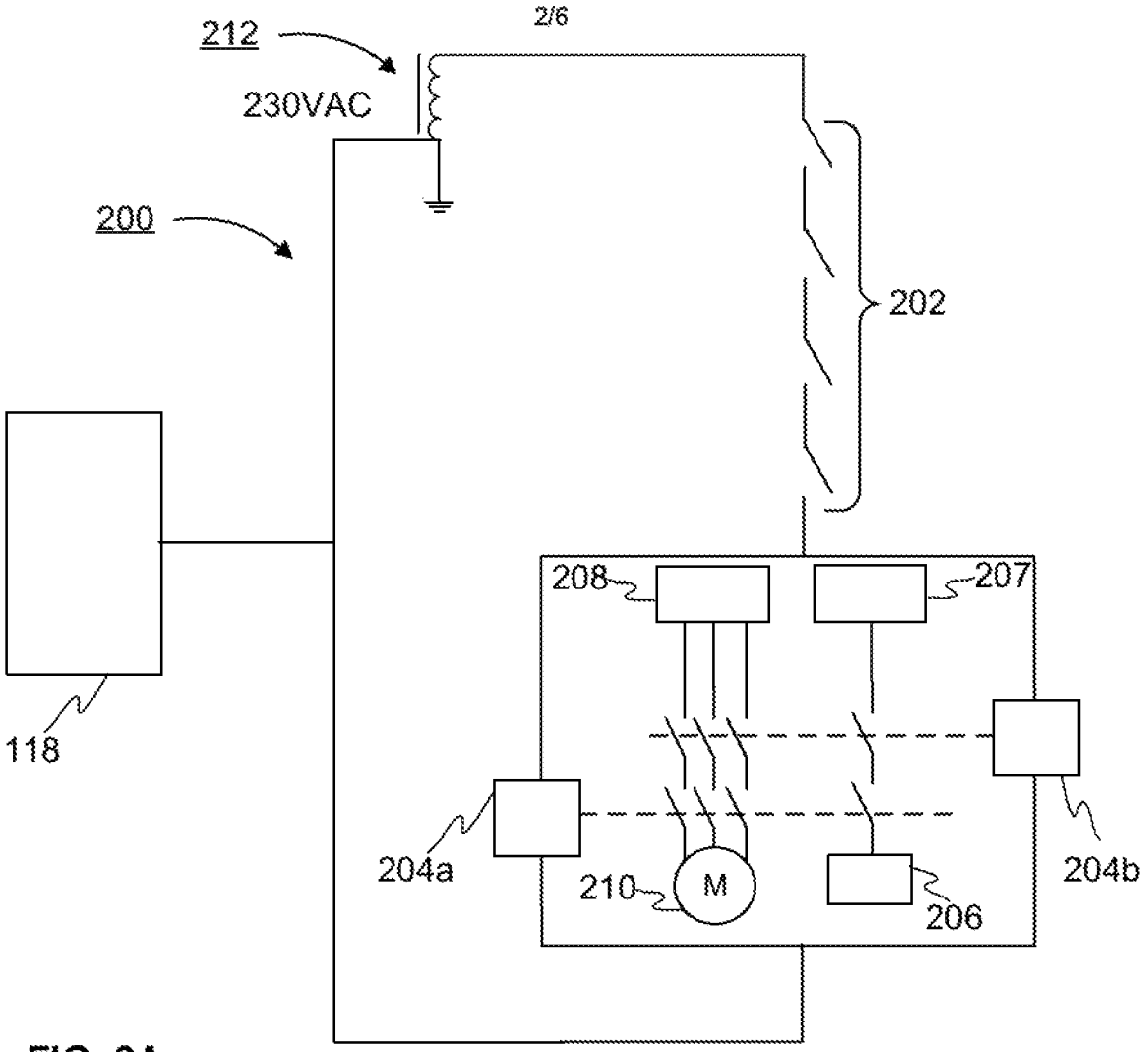
FIG. 2A illustrates schematically an example of a conventional safety circuit according to the invention.

The invention may be implemented with a conventional safety circuit to which several safety contacts are connected in series. FIG. 2A schematically illustrates a simple example of the conventional safety circuit 200 comprising safety contacts 202 connected in series. The safety circuit 200 comprises further safety relays 204*a*, 204*b* connected in connection with machinery brakes 206 and an elevator motor 210. The safety relays 204*a*, 204*b* are connected in connection with the machinery brakes 206 and brake controller 207 and the frequency converter 208 and the elevator motor 210 so that when the safety circuit 200 is open, i.e. the current flow in the safety circuit 200 is interrupted, the machinery brakes 206 activate to brake the movement of the elevator car 102 and the power supply from the frequency converter 208 to the elevator motor 210 is stopped. In FIG. 2A the safety circuit 200 is connected to an AC voltage source 212. Alternatively the safety circuit 200 may be connected to a DC voltage source. The safety circuit 200 may further be connected to the detection unit 118 that may be implemented as the elevator control unit 110 or as the separate unit. Alternatively, if the detection unit 118 is implemented the separate unit, the detection unit 118 may be separate from the safety circuit 200.

Figure 2B:
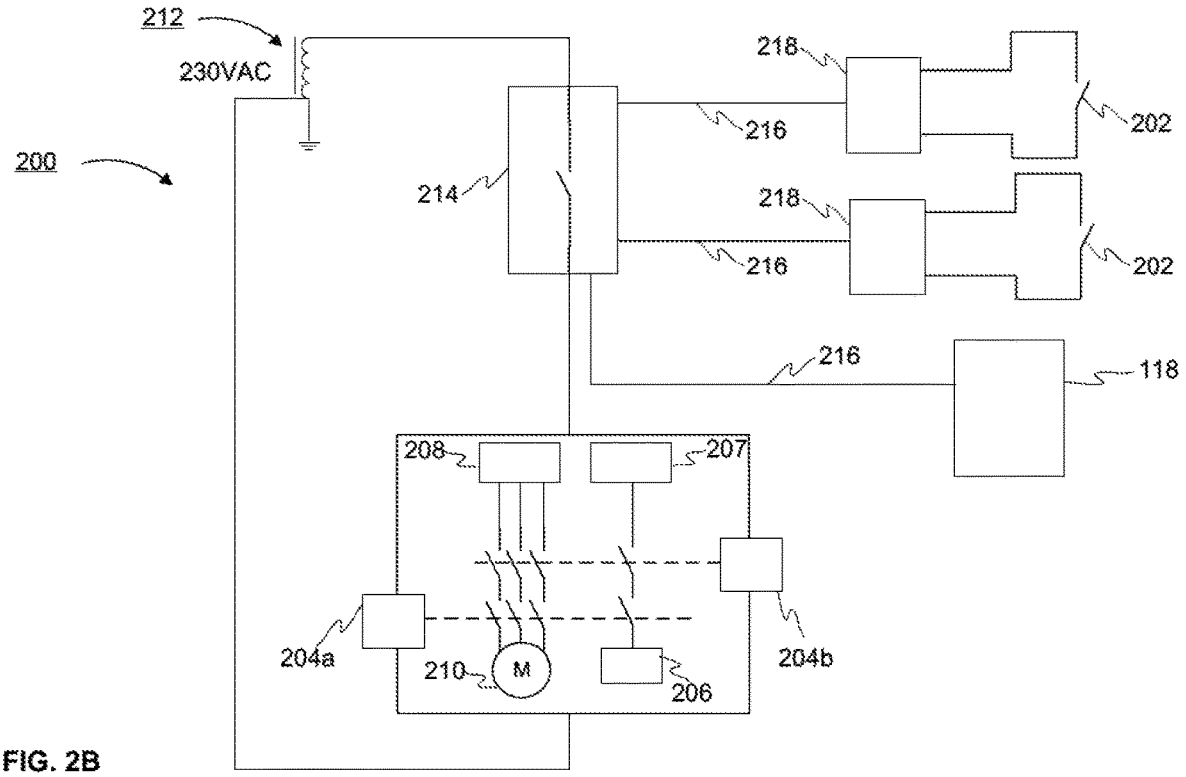
FIG. 2B illustrates schematically another example of a data bus-based safety circuit according to the invention.

Alternatively, the invention may be implemented as data bus-based safety circuit. In this case the safety contacts are not directly in series connection but are connected to a safety controller 214 by means of a data bus 216. FIG. 2B schematically illustrates a simple example of the data bus-based safety circuit 200, wherein the safety contacts 202 are connected to the safety controller 214 by means of at least one data bus 216 and at least one safety node 218. One or more safety contacts 202 may be connected to one safety node 218. The safety circuit 200 comprises further safety relays 204*a*, 204*b* connected in connection with machinery brakes 206 and an elevator motor 210 similarly as already discussed in the context of FIG. 2A relating to the conventional safety circuit 200. The safety controller 214 may further be connected to the detection unit 118 by means of a data bus 216. The detection unit 118 may be implemented as the elevator control unit 110 or as the separate unit. Alternatively, if the detection unit 118 is implemented the separate unit, the detection unit 118 may be separate from the safety circuit 200. In FIG. 2B the safety circuit 200 is connected to an AC voltage source 212. Alternatively, the safety circuit 200 may be connected to a DC voltage source.

FIGS. 2A and 2B illustrate non-limiting examples of safety circuits with which the invention may be implemented. The invention may be implemented with any conventional safety circuit comprising any number and any type of safety contacts. Similarly, the invention may be implemented with any data bus-based safety circuit comprising any number and any type of safety contacts. In case of the conventional safety circuits only opening or closing of the whole safety circuit may be detected, not opening or closing of individual safety contacts. In case of the data bus-based safety circuits opening and closing of each individual safety contact of the safety circuit may be detected. In order to be able to detect the opening and closing of each individual safety contact 202, only one safety contact 202 may be connected to each safety node 218 may, i.e. each safety contact 202 must be connected to individual safety nodes 218. This is illustrated in FIG. 2B, wherein each safety contact 202 is connected to individual safety node 218. This enables that the operation, such as opening or closing times for example, of each safety contact may be observed separately. This in turn enables that a reason for a failure may be defined more efficiently.

Figure 3A:
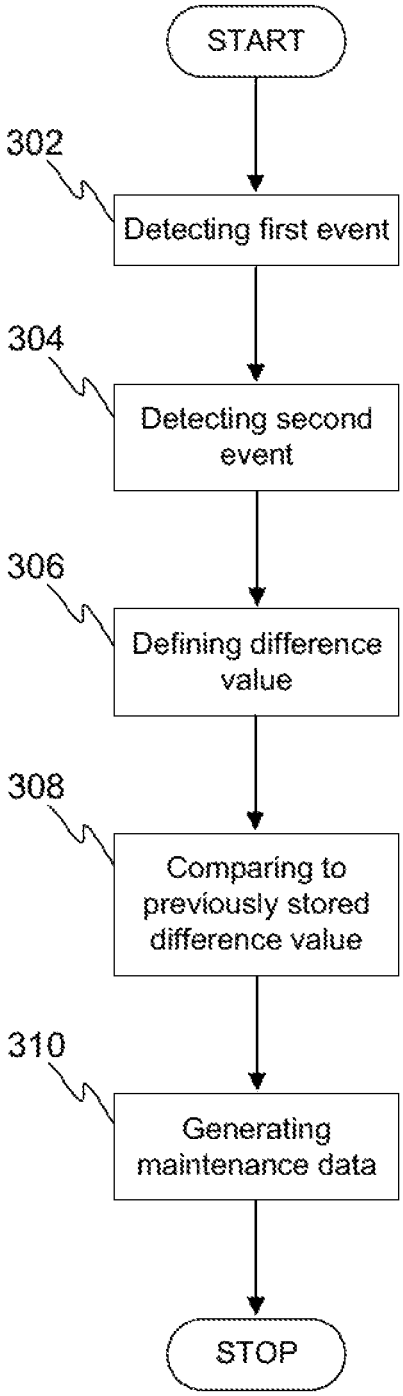
FIG. 3A illustrates schematically an example of a method according to the invention.

The method according to the invention enables generating maintenance data of the elevator door system. Next an example of a method according to the invention is described by referring to FIG. 3A. FIG. 3A schematically illustrates the invention as a flow chart. The detection unit 118 detects 302 a first event during closing or opening of a door of the elevator door system and defines a time stamp of the first event. The time stamp of the first event represents the time instant, when the first event is detected to occur. The first event may be opening or closing of a safety circuit. The safety circuit is opened, when at least one of the safety contacts is opened. The safety circuit is closed, when all of the safety contacts of the safety circuit are closed. The door of the elevator door system may be at least one of the following: elevator car door, landing door. In context of this application the opening of the door of the elevator door system may be defined to start from the moment when the door receives from the door control unit an instruction to start the opening of the door and to stop when the door movement of the door is ended and the door is defined to be open. The closing of the door of the elevator door system, in turn, in the context of this application may be defined to start from the moment when the door receives from the door control unit an instruction to start closing the door and to stop at the moment when the safety circuit is closed.

Furthermore, the detection unit 118 detects 304 at least one second event during said closing or opening of the door of the elevator door system and defines a time stamp of the at least one second event. The time stamp of the second event represents the time instant, when the second event is detected to occur. The at least one second event may be at least one of the following: increase of a door motor current value, instruction from the elevator control unit to the door control unit of the elevator door system to open or close the door, random sequential repetition in the opening or closing of the safety circuit. The random sequential repetition in the opening or closing of the safety circuit in the context of this application means a situation, where the contact is not made properly, i.e. the contact opens and closes randomly or the contact has random delays. If the safety circuit is implemented as data-bus based safety circuit, the at least one second event may additionally or alternatively be opening or closing of at least one individual safety contact of the safety circuit.

If the safety circuit is implemented as the conventional safety circuit, the detection unit 118 detects the closing or opening of the safety circuit. Alternatively, if the safety circuit is implemented as the data bus-based safety circuit, the safety controller detects the closing or opening of the safety circuit and the safety controller conveys information indicating the closing or opening of the safety circuit to the detection unit 118.

If the detection unit 118 is implemented as a separate unit, the detection unit 118 detects the increase of the door motor current value, for example with a current measuring sensor. Alternatively, if the detection unit 118 is implemented as the elevator control unit 110, the detection unit 118 may receive information indicating the increase of the door motor current value from the door control unit 114. The detection unit 118 is configured to define the time stamps of the first event and second event.

If the detection unit 118 is implemented as a separate unit, the detection unit 118 may communicate the defined time stamp of the first event and the defined time stamp of the second event to the computing unit 120 that defines 306 a difference value by comparing the time stamp of the first event and the time stamp of the at least one second event. Furthermore, the computing unit 120 compares 308 the difference value to previously stored one or more difference values and generates 310 maintenance data of the elevator door system. Alternatively, if the detection unit 118 is implemented as the elevator control unit 110, the detection unit 118 may define 306 the difference value by comparing the time stamp of the first event and the time stamp of the at least one second event. Furthermore, the detection unit 118 may compare 308 the difference value to previously stored one or more difference values and generates 310 maintenance data of the elevator door system for the computing unit 120. Alternatively, in case that the detection unit 118 is implemented as the elevator control unit 110, the defined time stamp of the first event and the defined time stamp of the second event may be communicated to the computing unit 120 and the computing unit 120 may perform the steps 306-310 as defined above for the embodiment, wherein the detection unit 118 is implemented as the separate unit.

The maintenance data comprises at least part of the results of the comparison. The previously stored one or more difference value may be at least one of the following: difference value previously defined and stored for the same safety circuit at the same landing, difference value previously defined and stored for the same safety circuit at one or more other landings, difference value previously defined and stored for one or more similar safety circuits. The one or more similar safety circuits may be a similar safety circuit of any another elevator system. The one or more similar safety circuits may reside in different elevator, different elevator system, different elevator group, different building, or even in an elevator on the other side of the world. The communication between the detection unit 118 and the computing unit 120 may be based on one or more known wireless communication technologies.

Figure 3B:
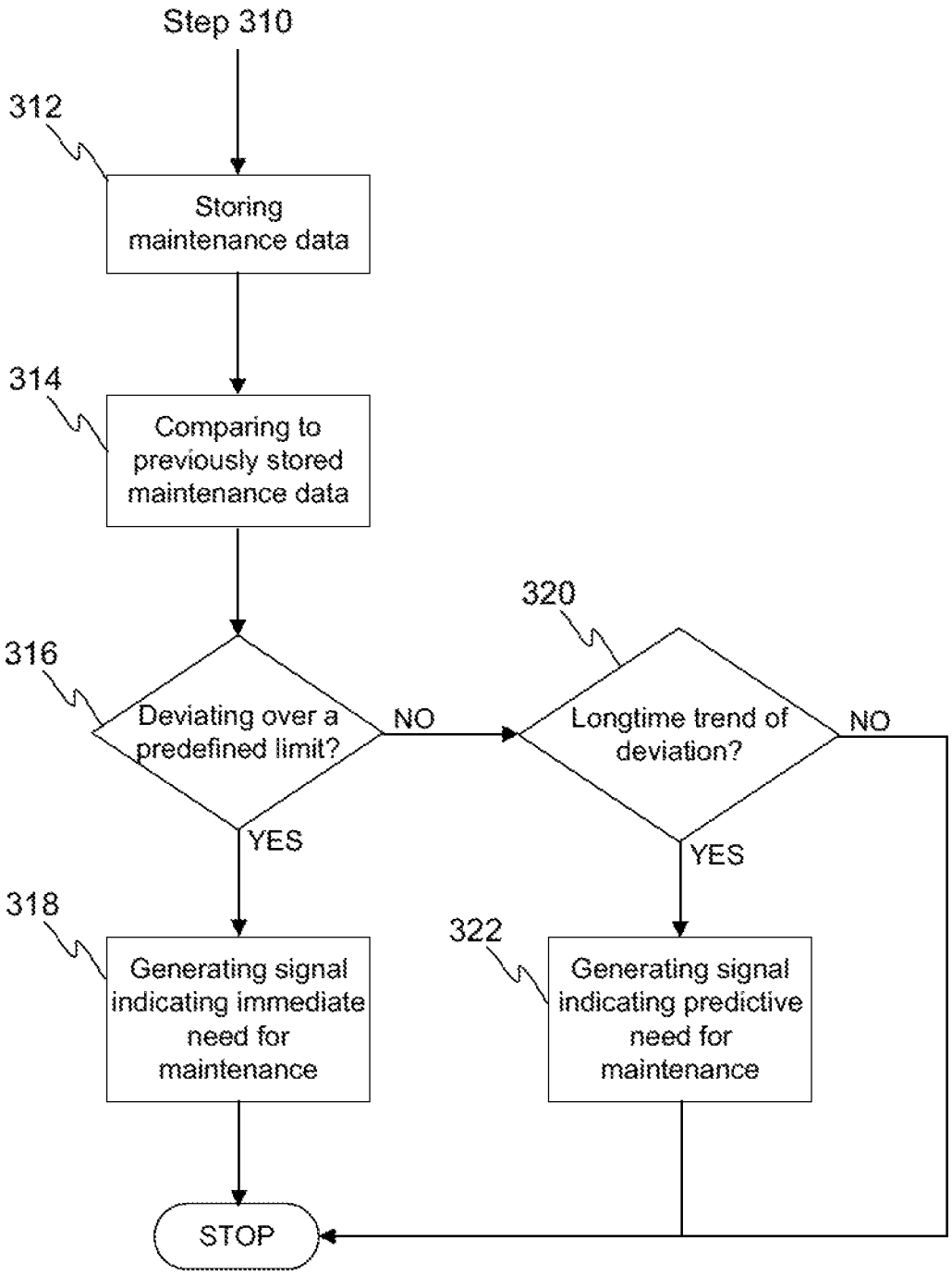
FIG. 3B illustrates schematically another example of the method according to the invention.

Next an example of further steps of the method according to the invention is described by referring to FIG. 3B. After generation of the maintenance data the computing unit 120 may store 312 the maintenance data transmitted from the detection unit 118 or generated by the computing unit 120 by itself. The computing unit 120 may compare 314 the maintenance data to previously stored maintenance data. The previously stored maintenance data may be at least one of the following: maintenance data previously generated and stored for the same safety circuit at the same landing, maintenance data previously defined and stored for the same safety circuit at one or more other landings, maintenance data previously defined and stored for one or more similar safety circuits. The one or more similar safety circuits may be a similar safety circuit of any another elevator system. The computing unit 120 may generate 318 a signal indicating an immediate need for maintenance of the elevator door system for an elevator service unit in response to a detection that the received maintenance data deviates 316 from the previously stored maintenance data over a predefined limit. This enables that an immediate need for maintenance of the elevator door system may be provided nearly in real time, which at least partly improves the availability of the elevator system, i.e. the time when the elevator system is in operation. The predefined limit may be a value indicating a failure in the elevator system that need to be fixed or replaced immediately. Alternatively, the computing unit 120 may generate 322 a signal indicating a predictive need for maintenance of the elevator door system for the elevator service unit in response to a detection that the stored maintenance data together with the previously stored maintenance data indicates 320 a longtime trend of a deviation in the stored maintenance data. The deviation may be, for example linear, gradual, or exponential. This enables that failures caused for example by wearing of one or more components of the elevator system over a longtime may be detected before the operation of the elevator system is stopped because of the failure. This, in turn, enables that the failure may be fixed, i.e. the damaged component may be replaced, before the operation of the elevator system is stopped because of the failure. This at least partly improves the availability of the elevator system, i.e. the time when the elevator system is in operation.

The computing unit 120 may further transmit the generated signal indicating the need for maintenance to the elevator service unit that is communicatively coupled to the computing unit 120. The communication between the computing unit 120 and the elevator service unit may be based on one or more known communication technologies, either wired or wireless. Preferably, the generated signal indicating the need for maintenance may be transmitted to the elevator service unit in real time. The elevator service unit may be for example a service center, service company or similar. In response to receiving the signal indicating the need for maintenance the elevator service unit may be configured to instruct maintenance personnel to fix a failure of the elevator door system, for example.

Additionally, the signal indicating the need for maintenance may carry information about at least one of the following: type of the failure, reason for the failure, location of the failure. The type, reason, or location of the failure may be defined based on the combination of the first event and the second event. For example if it is detected that the closing time of a landing door is increasing only at one landing and the door motor current value is normal at all landings, it may be defined a failure with the landing door lock at said lading. According to another example, if it is detected that the closing times of landing doors at all landings increase and the door motor current value increases at all landings, it may be defined a failure with the movement the elevator car door.

This enables that the reason, type, and/or location of the failure may be defined even before the operation of the elevator stops or at least in real time. This, in turn, enables that the failure may be preferably fixed even before the operation of the elevator stops or at least immediately after the failure is detected. Furthermore, time may be saved in fixing of the failure, when the type, the reason, and/or the location of the failure may be already known beforehand due to the generated signal indicating the need for maintenance, either immediate need or predictive need.

Figure 4:
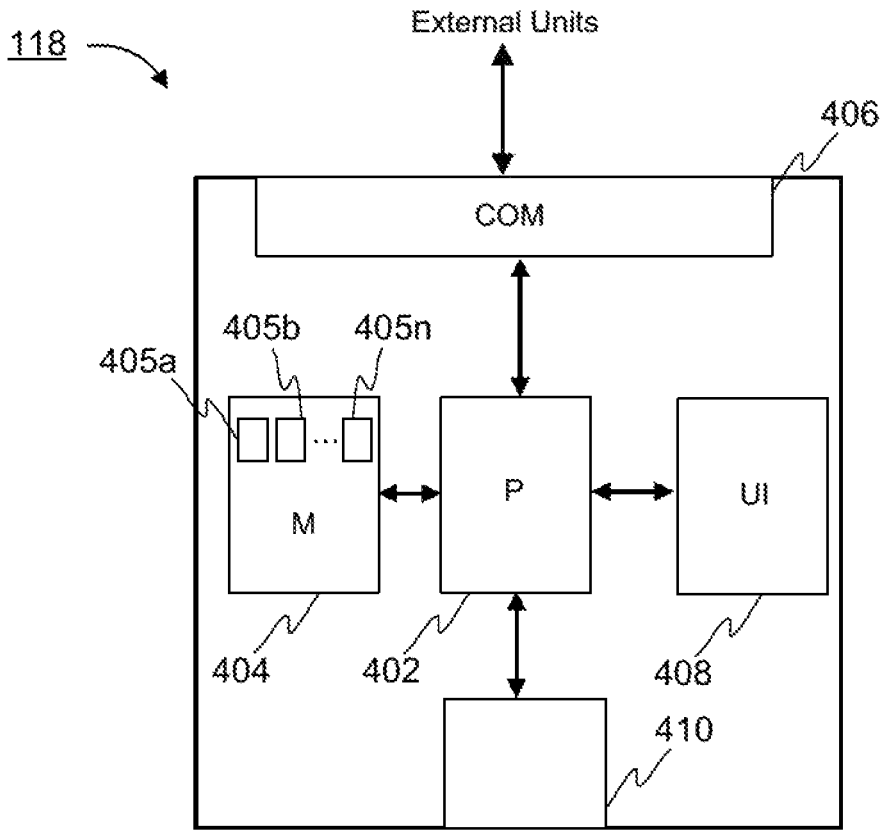
FIG. 4 illustrates schematically an example of a detection unit according to the invention.

FIG. 4 illustrates schematically an example of a detection unit 118 according to the invention. The detection unit 118 comprises at least one processor 402, at least one memory 404, a communication interface 406, possibly at least one user interface 408 and sensor related devices 410. The sensor related devices 410 may comprise, but are not limited to, one or more sensor for detecting the door motor current, one or more sensor for detecting the opening and closing of the safety circuit, one or more sensor for detecting the opening and closing of each safety contact. The mentioned elements of may be communicatively coupled to each other with e.g. an internal bus. The at least one processor 402 may be any suitable for processing information and control the operation of the detection unit 118, among other tasks. The at least one processor 402 of the detection unit 118 is at least configured to implement at least some method steps as described above. The processor 402 of the detection unit 118 is thus arranged to access the at least one memory 404 and retrieve and store any information therefrom and thereto. The operations may also be implemented with a microcontroller solution with embedded software. The at least one memory 404 may be configured to store portions of computer program code 405*a*-405*n* and any data values. Furthermore, the at least one memory 404 may be volatile or non-volatile. Moreover, the at least one memory 404 is not limited to a certain type of memory only, but any memory type suitable for storing the described pieces of information may be applied in the context of the invention. The communication interface 406 may be based on at least one known communication technologies, either wired or wireless, in order to exchange pieces of information as described earlier. The communication interface 406 provides an interface for communication with any external unit, such as the computing unit 120, database and/or any external systems.

Figure 5:
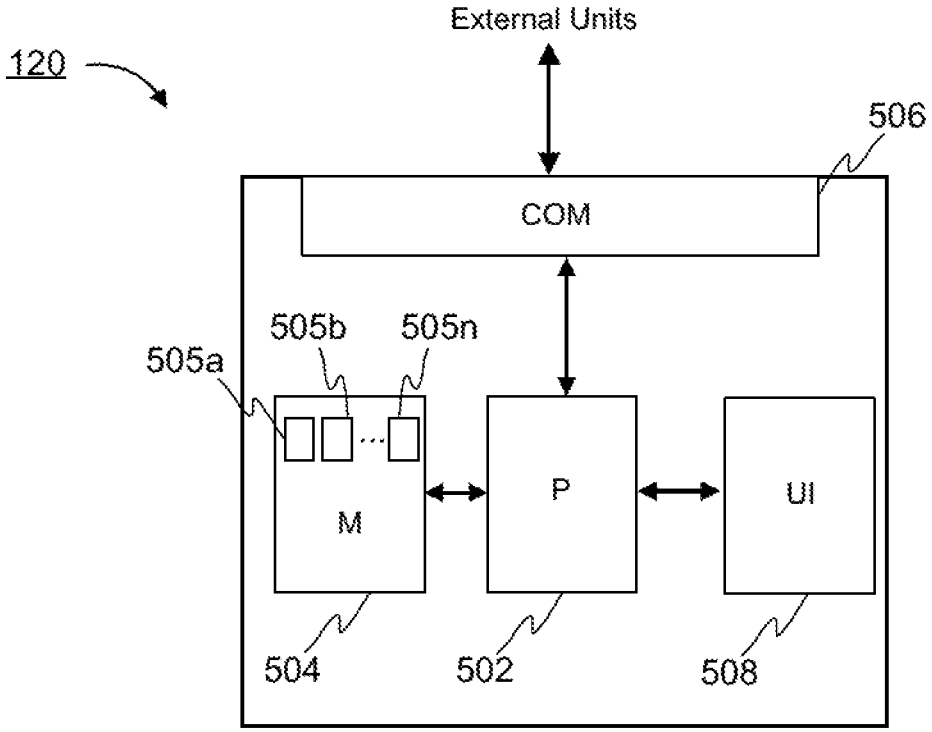
FIG. 5 illustrates schematically an example of a computing unit according to the invention.

FIG. 5 illustrates schematically an example of a computing unit 120 according to the invention. The computing unit 120 may comprise at least one processor 502, at least one memory 504, a communication interface 506, and one or more user interfaces 508. The at least one processor 502 may be any suitable for processing information and control the operation of the computing unit 120, among other tasks. The at least one processor 502 of the computing unit 120 is at least configured to implement at least some method steps as described above. The at least one processor 502 of the computing unit 120 is thus arranged to access the at least one memory 504 and retrieve and store any information therefrom and thereto. The operations may also be implemented with a microcontroller solution with embedded software. The at least one memory 504 may be volatile or non-volatile. Moreover, the at least one memory 504 may be configured to store portions of computer program code 505*a*-505*n* and any data values. The at least one memory 504 is not limited to a certain type of memory only, but any memory type suitable for storing the described pieces of information may be applied in the context of the present invention. The communication interface 506 provides interface for communication with any external unit, such as with detection unit 118, elevator service unit and/or any external systems. The communication interface 506 may be based on one or more known communication technologies, either wired or wireless, in order to exchange pieces of information as described earlier. The mentioned elements of the computing unit 120 may be communicatively coupled to each other with e.g. an internal bus.

One advantage of the above described invention is that the generated maintenance data may be used to detect the need for the maintenance, i.e. a failure, earlier than normally, i.e. during the maintenance visits. Furthermore, the invention enables that the maintenance data may be generated remotely. Thus, costs of a site visit may be saved by enabling maintenance person to prepare for maintenance visit with correct spare components, because the need for the maintenance may be defined remotely. Moreover, the above described invention improves the availability of the elevator system, i.e. the time when the elevator system is in operation. Thus, also the customer's satisfaction may be at least partly increased.

Alternatively or in addition, the above described invention may be employed for providing quality information of the landing door installation. During the commission of the elevator door system the door opening and closing times and the door motor current values at each landing should be approximately the same, because the components are new and well installed. The system and method according to the invention may be used to detect a deviation between the landings in order to provide quality information of the landing door installation. For example if the closing time of one landing door differs from the closing times of other landings, it may indicate that the installation of the landing door having different closing time is not properly performed.

Alternatively or in addition, the above described invention may be employed for providing maintenance data of a synchronization system. In the context of this application with the synchronization system is meant a mechanical transmission between door panels. The synchronization system may comprise a rope and pulley, for example. During the commission of the elevator door system the opening and closing times at the elevator car door side and at the landing door side should be approximately the same, because the components are new and well installed. The system and method according to the invention may be used to detect a deviation between the opening and closing times of the elevator car door side and landing door side order to provide maintenance data of the synchronization system. For example if the closing time (or opening time) of the elevator door begins to differ from the closing time (or opening time) of landing door, it may indicate a need for maintenance of the synchronization system.

The specific examples provided in the description given above should not be construed as limiting the applicability and/or the interpretation of the appended claims. Lists and groups of examples provided in the description given above are not exhaustive unless otherwise explicitly stated.

The invention claimed is:

1. A method for generating maintenance data of an elevator door system, the method comprising the steps of:

detecting a first event during closing or opening of a door of the elevator door system and defining a time stamp of the first event, wherein the first event is opening or closing of a safety circuit, which comprises at least one safety contact;

detecting at least one second event during said closing or opening of the door of the elevator door system and defining a time stamp of the at least one second event;

defining a difference value by comparing the time stamp of the first event and the time stamp of the at least one second event;

comparing the difference value to previously stored one or more difference values; and generating maintenance data of the elevator door system, wherein the maintenance data comprises at least part of the results of the comparison.

2. The method according to claim 1, wherein the method further comprises the steps of:

storing the maintenance data;

comparing the maintenance data to a previously stored maintenance data; and generating a signal indicating an immediate need for maintenance of the elevator door system in response to a detection that the received maintenance data deviates from the previously stored maintenance data over a predefined limit; or generating a signal indicating a predictive need for maintenance of the elevator door system in response to a detection that the stored maintenance data together with the previously stored maintenance data indicates a longtime trend of a deviation in the stored maintenance data.

3. The method according to claim 1, wherein the door of the elevator door system is at least one of the following: elevator car door, landing door.

4. The method according to claim 1, wherein the at least one safety contact of a safety circuit is at least one of the following: elevator car door contact, landing door contact, elevator car door lock contact, landing door lock contact.

5. The method according to claim 1, wherein the one or more previously stored difference value is at least one of the following: difference value previously defined and stored for the same safety circuit at the same landing, difference value previously defined and stored for the same safety circuit at one or more other landings, difference value previously defined and stored for one or more similar safety circuits.

6. The method according to claim 1, wherein the at least one second event is at least one of the following: increase of a door motor current value, instruction from an elevator control unit to a door control unit of the elevator door system to open or close the door, random sequential repetition in the opening or closing of the safety circuit.

7. The method according to claim 6, wherein the safety circuit is implemented as a data-bus based safety circuit, the at least one second event is opening or closing of the at least one safety contact of the safety circuit.

8. The method according to claim 2, wherein the door of the elevator door system is at least one of the following: elevator car door, landing door.

9. The method according to claim 2, wherein the at least one safety contact of a safety circuit is at least one of the following: elevator car door contact, landing door contact, elevator car door lock contact, landing door lock contact.

10. The method according to claim 3, wherein the at least one safety contact of a safety circuit is at least one of the following: elevator car door contact, landing door contact, elevator car door lock contact, landing door lock contact.

11. The method according to claim 2, wherein the one or more previously stored difference value is at least one of the following: difference value previously defined and stored for the same safety circuit at the same landing, difference value previously defined and stored for the same safety circuit at one or more other landings, difference value previously defined and stored for one or more similar safety circuits.

12. The method according to claim 3, wherein the one or more previously stored difference value is at least one of the following: difference value previously defined and stored for the same safety circuit at the same landing, difference value previously defined and stored for the same safety circuit at one or more other landings, difference value previously defined and stored for one or more similar safety circuits.

13. A system for generating maintenance data of an elevator door system, the system comprising:

a computing unit comprising:

at least one processor; and at least one memory storing at least one portion of computer program code; and a detection unit comprising:

at least one processor; and at least one memory storing at least one portion of computer program code, wherein the detection unit is configured to:

detect a first event during closing or opening of a door of the elevator door system and define a time stamp of the first event, wherein the first event is opening or closing of a safety circuit comprising at least one safety contact; and detect at least one second event during said closing or opening of the door of the elevator door system and defining a time stamp of the at least one second event, wherein one of the following: detection unit, computing unit, is configured to:

define a difference value by comparing the time stamp of the first event and the time stamp of the at least one second event;

compare the difference value to previously stored one or more difference values; and generate maintenance data of the elevator door system, wherein the maintenance data comprising at least part the results of the comparison.

14. The system according to claim 13, wherein the computing unit is configured to:

store the maintenance data;

compare the maintenance data to previously stored maintenance data; and generate a signal indicating an immediate need for maintenance of the elevator door system in response to a detection that the received maintenance data deviates from the previously stored maintenance data over a predefined limit; or generate a signal indicating a predictive need for maintenance of the elevator door system in response to a detection that the stored maintenance data together with the previously stored maintenance data indicates a longtime trend of a deviation in the stored maintenance data.

15. The system according to claim 13, wherein the door of the elevator door system is at least one of the following: elevator car door, landing door.

16. The system according to claim 13, wherein the at least one safety contact of a safety circuit is at least one of the following: elevator car door contact, landing door contact, elevator car door lock contact, landing door lock contact.

17. The system according to claim 13, wherein the previously stored difference value is at least one of the following: difference value previously defined and stored for the same safety circuit at the same landing, difference value previously defined and stored for the same safety circuit at one more other landings, difference value previously defined and stored for one or more similar safety circuits.

18. The system according to claim 13, wherein the detection unit is one of the following: an elevator control unit, a door control unit, a separate unit retrofittable to the elevator system.

19. The system according to claim 13, wherein the at least one second event is at least one of the following: increase of a door motor current value, instruction from an elevator control unit to a door control unit of the elevator door system to open or close the door, random sequential repetition in the opening or closing of the safety circuit.

20. The system according to claim 19, wherein the safety circuit is implemented as a data-bus based safety circuit, the at least one second event is opening or closing of the at least one safety contact of the safety circuit.

* * * * *